US011830394B2

(12) United States Patent
Wooster et al.

(10) Patent No.: US 11,830,394 B2
(45) **Date of Patent: *Nov. 28, 2023**

(54) METHODS AND APPARATUS TO MANAGE DISPLAY LUMINANCE

(71) Applicant: Intel Corporation, Santa Clara, CA (US)

(72) Inventors: Roland Wooster, Folsom, CA (US); Perazhi Sameer Kalathil, Bangalore (IN)

(73) Assignee: Intel Corporation, Santa Clara, CA (US)

( * ) Notice: Subject to any disclaimer, the term of this patent is extended or adjusted under 35 U.S.C. 154(b) by 35 days.

This patent is subject to a terminal disclaimer.

(21) Appl. No.: 17/561,235

(22) Filed: Dec. 23, 2021

(65) Prior Publication Data

US 2022/0114932 A1 Apr. 14, 2022

Related U.S. Application Data

(63) Continuation of application No. 16/728,934, filed on Dec. 27, 2019, now Pat. No. 11,217,132.

(51) Int. Cl.
*G09G 3/00* (2006.01)

(52) U.S. Cl.
CPC ..... *G09G 3/006* (2013.01); *G09G 2320/0233* (2013.01); *G09G 2320/0247* (2013.01);
(Continued)

(58) Field of Classification Search
CPC ..... G09G 3/006; G09G 2320/0233; G09G 2320/0247; G09G 2320/0633
See application file for complete search history.

(56) References Cited

U.S. PATENT DOCUMENTS 9,326,346 B2 4/2016 Catalano et al.
9,596,738 B2 3/2017 Catalano et al.
(Continued)

OTHER PUBLICATIONS

European Patent Office, "European Search Report," issued in connection with European Patent Application No. 20197343.5, dated Feb. 19, 2021, 11 pages.
(Continued)

*Primary Examiner* — Sejoon Ahn
(74) *Attorney, Agent, or Firm* — HANLEY, FLIGHT & ZIMMERMAN, LLC

(57) ABSTRACT

Methods, apparatus, systems and articles of manufacture are disclosed to manage display luminance, for the purpose of power efficiency, halo reduction, and flicker prevention. An example apparatus includes a backlight analyzer to determine a first baseline luminance level associated with a first segment of a backlight of a screen of a display device based on pixel data defining a frame of content to be displayed via the screen and to determine a second baseline luminance level associated with a second segment of the backlight different than the first segment based on the pixel data, a segment-pair ratio analyzer to determine a segment-pair luminance ratio between the first and second segments based on the first and second baseline luminance levels, and a luminance controller to adjust an amount of power provided to at least one of the first segment of the backlight or the second segment of the backlight when the segment-pair luminance ratio satisfies a threshold.

20 Claims, 6 Drawing Sheets

(52) U.S. Cl.
CPC ..... *G09G 2320/0633* (2013.01); *G09G 2360/141* (2013.01); *G09G 2360/144* (2013.01)

(56) References Cited

U.S. PATENT DOCUMENTS

| | | | | |
|---|---|---|---|---|
| 9,668,306 | B2 | 5/2017 | Harrison et al. | |
| 11,217,132 | B2 | 1/2022 | Wooster et al. | |
| 2008/0111784 | A1 | 5/2008 | Tanaka et al. | |
| 2011/0122168 | A1* | 5/2011 | Lee | G09G 3/3426 345/102 |
| 2016/0203774 | A1 | 7/2016 | Ahn et al. | |
| 2017/0039967 | A1 | 2/2017 | Jung et al. | |
| 2018/0182321 | A1* | 6/2018 | Zeng | G09G 3/3607 |
| 2018/0182351 | A1* | 6/2018 | Lin | G09G 5/02 |
| 2018/0268781 | A1 | 9/2018 | Park et al. | |
| 2019/0043442 | A1 | 2/2019 | Kp et al. | |
| 2019/0304389 | A1* | 10/2019 | Zhang | G09G 3/002 |
| 2019/0304398 | A1* | 10/2019 | Lv | G09G 5/02 |
| 2019/0304999 | A1* | 10/2019 | Wang | H01L 27/124 |

OTHER PUBLICATIONS

United States Patent and Trademark Office, "Non-Final Office Action," issued in connection with U.S. Appl. No. 16/728,934, dated May 12, 2021, 7 pages.

United States Patent and Trademark Office, "Notice of Allowance and Fee(s) Due," issued in connection with U.S. Appl. No. 16/728,934, dated Sep. 1, 2021, 9 pages.

European Patent Office, "Communication pursuant to Article 94(3) EPC," in connection with European Patent Application No. 20197343.5, dated Apr. 14, 2023, 9 pages.

* cited by examiner

METHODS AND APPARATUS TO MANAGE DISPLAY LUMINANCE

RELATED APPLICATION

This patent arises from a continuation of U.S. patent application Ser. No. 16/728,934 (now U.S. Pat. No. 11,217,132), which was filed on Dec. 27, 2019. U.S. patent application Ser. No. 16/728,934 is hereby incorporated herein by reference in its entirety. Priority to U.S. patent application Ser. No. 16/728,934 is hereby claimed.

FIELD OF THE DISCLOSURE

This disclosure relates generally to display screens, and, more particularly, to methods and apparatus to manage display luminance.

BACKGROUND

In recent years, high dynamic range (HDR) screens are increasingly incorporated into electronic devices such as computers, laptops, televisions, etc. In general, HDR screens utilize a greater range of luminance compared to traditional standard dynamic range (SDR) screens. Screen luminance is a measure of the amount of light emitted by the screen. HDR screens allow for a greater luminance differential between the brightest pixel and the darkest pixel of a screen, thus creating an increased contrast ratio and better image reproduction.

BRIEF DESCRIPTION OF THE DRAWINGS

The figures are not to scale. Instead, the thickness of the layers or regions may be enlarged in the drawings. In general, the same reference numbers will be used throughout the drawing(s) and accompanying written description to refer to the same or like parts.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

The use and number of high dynamic range (HDR) screens in display devices in recent years has increased. As used herein, a "display device" refers to any type of device with a display, such as laptop computers, tablets, standalone computer monitors, televisions, smartphones, portable computing devices, etc. HDR screens enable a greater luminance range for individual pixels of the screen than standard dynamic range (SDR) display devices. As used herein, "luminance range" refers to the range of luminance levels (e.g., 0-450 cd/m$^2$) that a screen is capable of providing for different pixels. The relatively high luminance range for HDR screens creates an increased contrast ratio and improved image quality. The greater luminance range (e.g., brighter whites and darker blacks) of HDR screens may involve an increase in backlight luminance. As used herein, "backlight luminance" refers to the light emitted from the backlight associated with the screen of the display device to illuminate individual pixels. In some examples, the backlight luminance is provided by an edge-based backlight where pixels are illuminated from lights shining from a perimeter of the screen. In other examples, the backlight luminance is provided by a direct backlight that is positioned behind the screen. In some examples, the backlight luminance of a display device is controlled and/or constrained by the luminance range of the display device. An increase in backlight luminance may increase power consumption, which is often an important design consideration, particularly for portable devices that are powered by a battery. Additionally, the greater luminance range of HDR screens may result in undesirable visible screen effects known as halos. Halos may occur when relatively highly contrasting regions (e.g., relatively bright and dark regions) of content are displayed adjacent one another on a screen. In such situations, the light from the portion of the backlight used to illuminate the relatively bright regions of content may spill into the adjacent relatively dark region causing the dark region to exhibit a halo effect.

Figure 1:
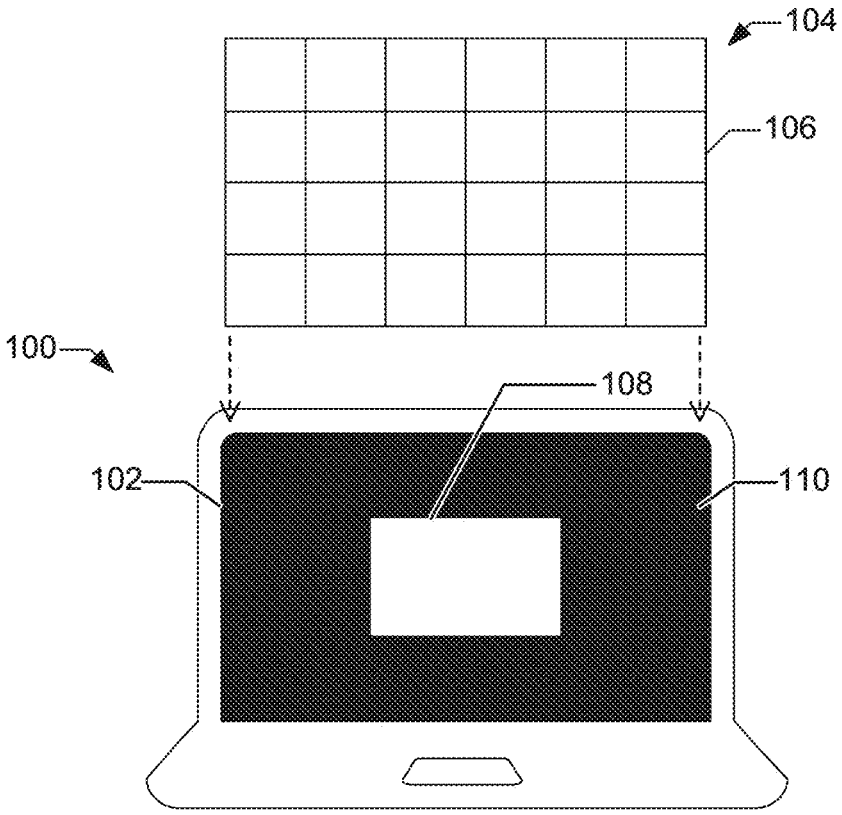
FIG. 1 is an example electronic display device equipped with a high dynamic range (HDR) display constructed in accordance with teachings of this disclosure.

FIG. 1 is an example display device 100 equipped with an HDR display 102 suitably constructed in accordance with teachings of this disclosure. In some examples, the display device 100 is a laptop or tablet. As used herein, "display," "screen," and "display screen" have the same meaning and refer to a structure to visibly convey an image, text, and/or other visual content to a human in response to an electrical control signal.

As shown in the illustrated example of FIG. 1, the example display device 100 includes an example backlight 104. The example backlight 104 is shown in FIG. 1 above the device 100 for purposes of illustration. However, the dotted arrows indicate that the backlight 104 is to be positioned behind a front facing surface of a display screen 102. In examples disclosed herein, the backlight 104 provides light to illuminate individual pixels of the display 102. In this example, the backlight 104 is a direct backlight and, therefore, is shown as approximately the same size as display 102. In other examples, the backlight 104 may be an edge backlight that is positioned along the edge and/or perimeter of the display 102. As shown in the illustrated example of FIG. 1, the backlight 104 may be divided into a plurality of backlight segments 106 that may be independently controlled to provide different luminance levels. In this example, the backlight 104 includes a 4×6 array of segments 106. In other examples, the backlight 104 may be divided into different numbers of segments 106 in different arrangements.

In some examples, the plurality of backlight segments 106 of the backlight 104 may have higher or lower backlight luminance levels (e.g., be brighter or darker) relative to one another depending on the pixel data defining the brightness of individual pixels of content to be displayed on the display 102 within regions corresponding to respective ones of the segments 106. For example, as represented in FIG. 1, the display 102 is rendering content that includes an example first region of relatively bright (e.g., white) content 108 in the center of the display 102 surrounded by an example second region of relatively dark (e.g., black) content 110. The first region of relatively bright content 108 includes pixel data associated with higher backlight luminance levels (e.g., appears brighter) compared to the second region of relatively dark content 110 (e.g., darker background). Thus, the segments 106 corresponding to the first region of content 108 (e.g., near the center of the display 102) have a higher backlight luminance level compared to the segments 106 corresponding to the second region of content 110 (e.g., near the perimeter of the display 102).

Figure 2:
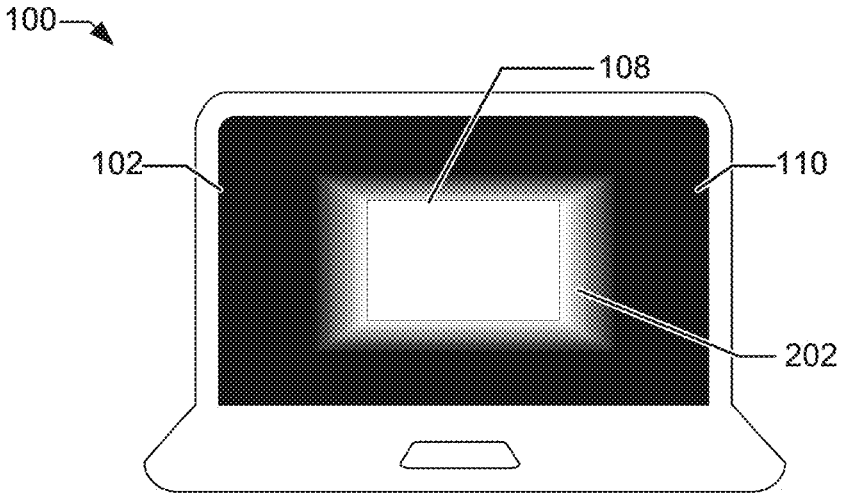
FIG. 2 is an example electronic display device equipped with a HDR display illustrating a halo screen effect.

As mentioned above, a relatively bright segment 106 (e.g., operating at high luminance level) of the backlight 104 adjacent a relatively dark segment 106 (e.g., operating at low luminance level) can produce unintended halo effects that appear on the display. This is represented for purposes of illustration in FIG. 2. In particular, FIG. 2 shows the display 102 rendering the same content as in FIG. 1 including the first region of relatively bright content 108 surrounded by the second region of relatively dark content 110. However, unlike in FIG. 1, the content rendered on the display 102 as represented in FIG. 2 includes an example halo 202. The halo 202 is not part of the content intended for rendering via the display 102 (e.g., the halo is not defined in pixel data defining the source image for the content). Rather, the halo 202 is a product of the underlying hardware generating the content that results from differences in backlight luminance levels between the segments 106 in the region of the relatively bright content 108 and the adjacent segments 106 along the perimeter of the display 102. Examples disclosed herein implement controls on the luminance of the backlight 104 and, more particularly, on the ratio defining the difference between the luminance levels of adjacent segments 106 of the backlight 104 to reduce (e.g., make negligible and/or eliminate) the halo effect (as represented in FIG. 2) such that the content appears substantially the same as the original source image defined by the corresponding pixel data (as represented in FIG. 1).

Figure 3:
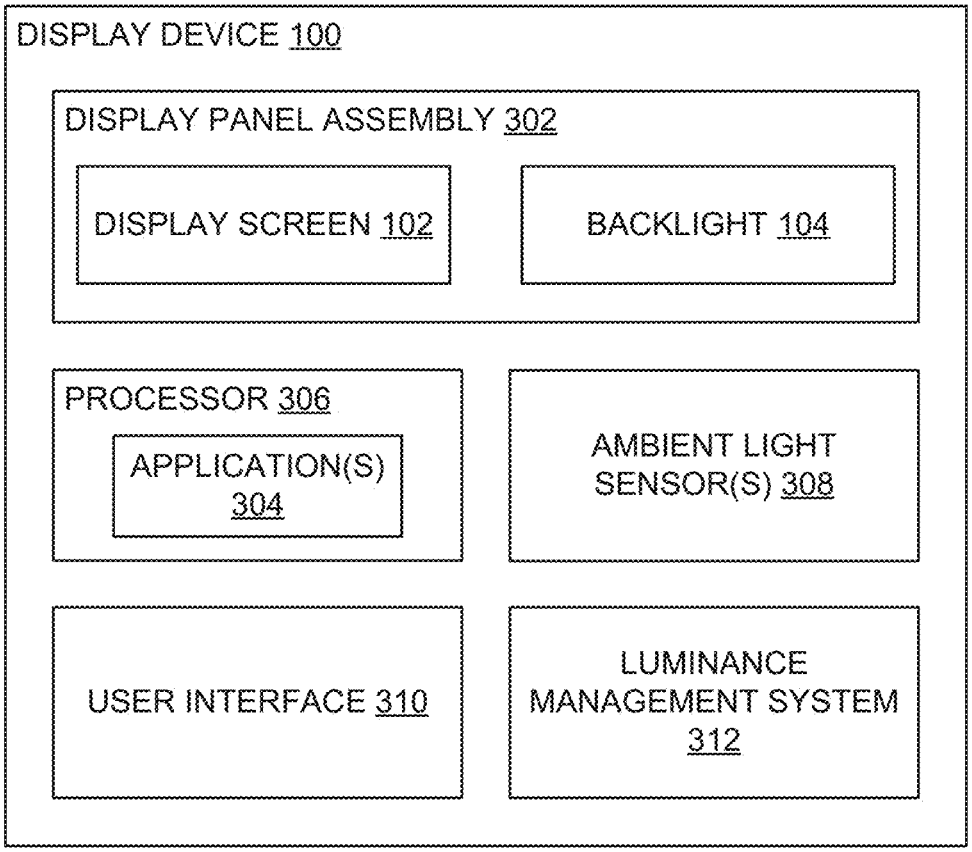
FIG. 3 is an example electronic display device equipped with an example luminance management system.

FIG. 3 is the example display device 100 of FIG. 1 equipped with an example luminance management system 312. The display device 100 includes a display panel assembly 302. The display panel assembly 302 includes the display screen 102 and the backlight 104 of FIG. 1. In the example of FIG. 3, a user may access one or more applications 304 (e.g., a word processing application, a web browser, a video player, etc.) executed by a processor 306 of the display device 100. The user of the display device 100 may view digital content associated with the application(s) 304 via the display screen 102. The display device 100 further includes one or more ambient light sensor(s) (ALSs) 308 to measure ambient light data of the environment in which the display device 100 is located within. The display device 100 may also include a user interface 310 to receive user input data. For example, the user interface 310 may receive data via a keyboard, a mouse, a touchscreen, a microphone, etc.

In the illustrated example of FIG. 3, the display device 100 includes a luminance management system 312 to manage the luminance of backlight segments 106 of the backlight 104 of the display 102 based on one or more inputs received from different sources. In some examples, the luminance management system 312 manages the global and local luminance levels of the backlight 104 of the display device 100. As used herein, the term "global" used in the context of "luminance levels" refers to the backlight luminance level for the entirety of the backlight 104. That is, an increase in the global luminance level results in a corresponding increase in the luminance level for every segment 106 of the backlight 104 by an equivalent amount. As used herein, the term "local" used in the context of "luminance levels" refers to the backlight luminance levels for individual ones (or a select subset) of the segments 106 of the backlight 104. That is, an increase in the local luminance level of a particular segment 106 results in a corresponding increase in the luminance level for that particular segment 106.

In the illustrated example of FIG. 3, the luminance management system 312 may receive usage data indicative of the usage of the display device 100. In some examples, the usage data includes an indication of the type of application(s) 304 currently being used on the display device 100, such as a word processor, a movie player, etc. In the illustrated example, the luminance management system 300 also may receive ambient lighting data based on an output of the ambient light sensor(s) 308 associated with the display device 100. In some examples, the ambient lighting data includes an indication of the ambient light conditions surrounding the display device 100. The luminance management system 312 further may receive user input data from a user via the user interface 310. In some examples, the user input data includes an indication of user preferences, such as preferences relating to power savings, global backlight luminance levels (e.g., screen brightness), luminance contrast, etc. The example luminance management system 312 obtains one or more of the usage data, the ambient lighting data, and the user input data to manage the global and local luminance of the display 102.

The example luminance management system 312 can be implemented by one or more processors of the display device 100, such as the processor 306 of FIG. 3. In some examples, the luminance management system 312 is implemented by one or more cloud-based devices, such as one or more servers, processors, and/or virtual machines located remotely from the display device 100. In other examples, some of the analysis performed by the luminance management system 312 is implemented by cloud-based devices and other parts of the analysis are implemented by local processor(s) or one or more user device(s).

Figure 4:
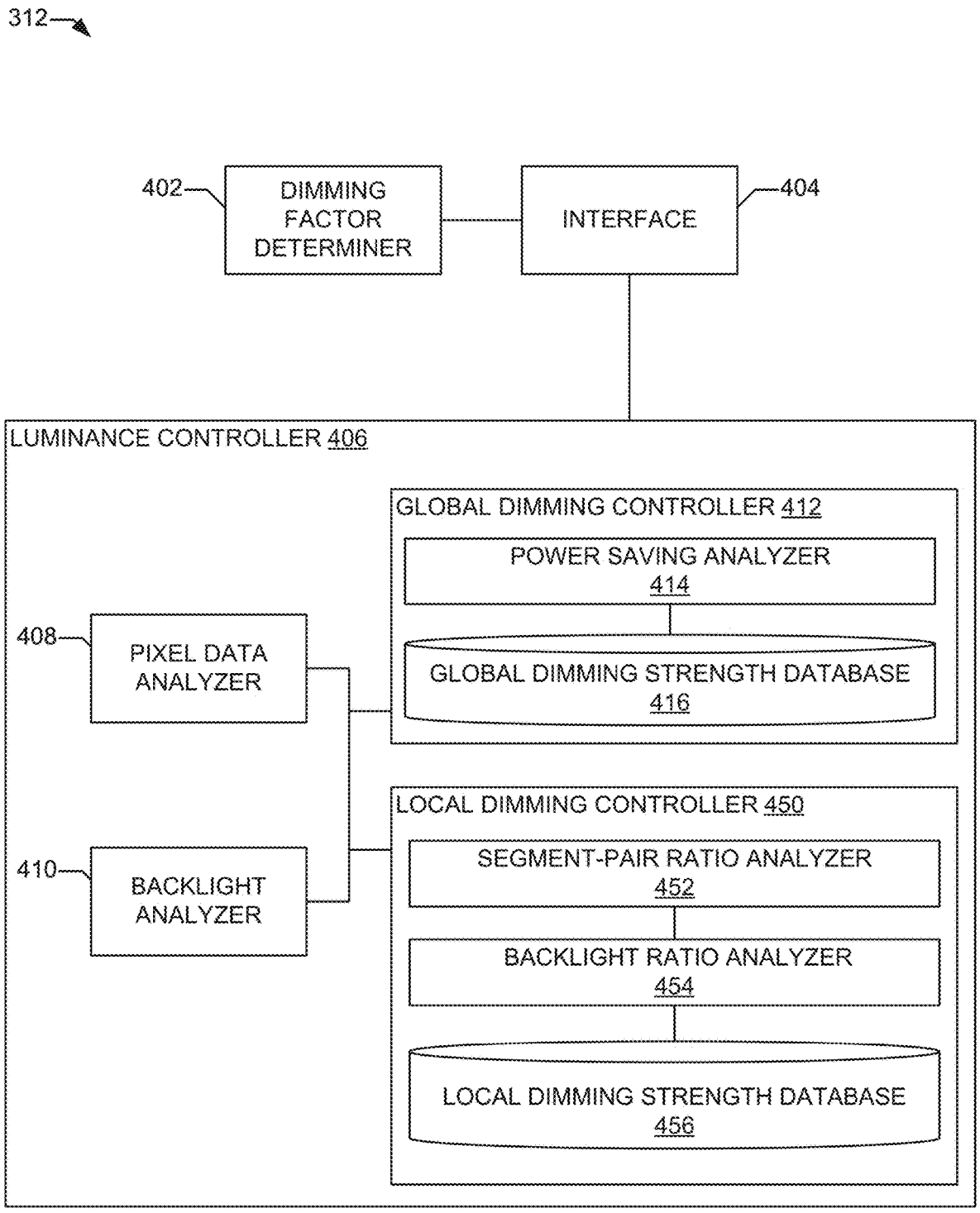
FIG. 4 is a block diagram illustrating an example implementation of the luminance management system of FIG. 3.

FIG. 4 is a block diagram illustrating an implementation of the example luminance management system 312 of FIG. 3. As shown in the illustrated example of FIG. 4, the luminance management system 312 includes an example dimming factor determiner 402, an example interface 404, an example luminance controller 406 including an example pixel data analyzer 408, an example backlight analyzer 410 410, an example global dimming controller 412 including an example power saving analyzer 414 and an example global dimming strength database 416. The example luminance controller 406 also includes an example local dimming controller 450 including an example segment-pair ratio analyzer 452, an example backlight ratio analyzer 454, and an example local dimming strength database 456.

In the illustrated example of FIG. 4, the dimming factor determiner 402 determines a value for a global dimming factor defining how much to adjust the global luminance level of the entire backlight 104 of the display 102 (e.g., adjust the luminance levels of each segment 106 of the backlight 104 consistently with adjustments to all other segments 106). Additionally or alternatively, the dimming factor determiner 402 may also determine a value for a local dimming factor defining how much to adjust individual ones of the segments 106 of the backlight 104 relative to other ones of the segments 106 (e.g., adjust local luminance levels for individual segments 106). As used herein, "global dimming" refers to the amount of reduction in power provided to the entire backlight 104 of the display 102 equally across all of the segments 106 of the backlight 104 (e.g., consistent reduction in power to each segment 106 of the backlight 104), thereby resulting in a reduction in the global luminance level associated with the backlight 104. As used herein, "local dimming" refers to the amount of reduction in power provided to individual ones of the segments 106 of the backlight 104, thereby resulting in a reduction in the local luminance level associated with the corresponding segments 106 of the backlight 104. Further detail regarding the determination of the global and local dimming factors is provided below.

In the illustrated example of FIG. 4, the example interface 404 receives the global and/or local dimming factors from the dimming factor determiner 402 and transmits the dimming factor(s) to the example luminance controller 406. In some examples, the luminance management system 312 includes the interface 404 because the dimming factor determiner 402 and the luminance controller 406 are implemented on separate circuitry. For instance, in some examples, the dimming factor determiner 402 is implemented by an operating system of the display device 100 executing on the processor 306 whereas the luminance controller 406 is implemented by a timing controller (TCON).

In the illustrated example of FIG. 4, the luminance controller 406 may increase or reduce the amount of power provided to some or all of the segments 106 to adjust the backlight luminance of the backlight 104 (e.g., the operating luminance level). In some examples, the luminance controller 406 adjusts the backlight power based on dimming factors defined by the dimming factor determiner 402 as described further below. In some examples, the luminance controller 406 is implemented by a timing controller (TCON) or any other suitable integrated circuit. In some examples, the luminance controller 406 sets (e.g., updates, adjusts) the backlight luminance levels for the segments 106 of the backlight 104. That is, the luminance controller 406 updates the luminance level (e.g., the intensity of emitted light) of the segments 106 of the backlight 104.

In some examples for liquid crystal display (LCD) screens, the brightness of content rendered on a screen may be adjusted independent of the power provided to a backlight by controlling and/or adjusting the transparency of the liquid crystals through which the light passes. The transparency of liquid crystals in an LCD screen may be adjusted based on whether the liquid crystals are in a twisted state or an untwisted state. That is, the liquid crystals of a display screen may be 100% transparent when they are in an untwisted state but decrease in transparency as they become more twisted. As used herein, "twisted state" or "untwisted state" refers to the configuration of liquid crystal molecules between at least two glass plates of a display. In some examples involving such an LCD display, the luminance controller 406 provides power to the example backlight 104 directly proportional to the desired luminance level at 100% transparency (e.g., when the liquid crystals are in an untwisted state). In some examples, the example luminance controller 406 may adjust the twist of individual pixels of the example display 102 to reduce the transparency and, thus, the brightness of the pixels. In some examples, the luminance controller 406 provides a relatively high power level to the example backlight 104 with a display 102 in a twisted state (e.g., transparency is less than 100%). For example, if the desired luminance level of the display 102 is 180 cd/m$^2$, the luminance controller 406 may provide a power level directly proportional to 180 cd/m$^2$ when the display 102 is 100% transparent. The example luminance controller 406 may also provide a power level corresponding to 300 cd/m$^2$ (or any other suitable luminance level) but adjust the transparency to the display 102 to 60% transparency (e.g., the liquid crystals of display 102 are in a twisted state), thus producing the same overall luminance level of 180 cd/m$^2$ (60% of 300 cd/m$^2$=180 cd/m$^2$).

In the illustrated example, the pixel data analyzer 408 of the luminance controller 406 obtains and/or identifies pixel data corresponding to content to be displayed by the display device 100 (e.g., on the display 102 of FIG. 1). As used herein, "pixel data" includes pixel values defining the brightness or intensity of each pixel (e.g., based on an assigned value from 0 to 255) for each frame or image to be rendered on the display. In some examples, the pixel data analyzer 408 obtains and/or identifies a global baseline luminance level corresponding to the luminance level for the backlight 104 that provides sufficient light to illuminate the pixel associated with the brightest pixel value across the entire display 102 of the display device 100. That is, the global baseline luminance level defines the theoretical minimum brightness of the backlight 104 needed to adequately illuminate the brightest pixel on the display 102. As used herein, "luminance value" and "luminance level" have the same meaning and refer to a value measuring the light emitted by the backlight 104. In some examples, the luminance value is measured in cd/m$^2$ (commonly referred to as nits). In some examples where the pixels represent color information, the pixel value for a particular pixel may be a vector of values defining the luminance level (e.g., brightness or intensity) for each of a red subpixel, a green subpixel, and a blue subpixel. In some such examples, the pixel data analyzer 408 identifies the pixel with the brightest pixel value as corresponding to the particular pixel associated with the highest value of a subpixel regardless of the values of the other subpixels associated with the particular pixel. The pixel data analyzer 408 may also obtain and/or identify different local baseline luminance levels corresponding to the luminance level for different segments 106 of the backlight 104 that provide sufficient light to illuminate the pixel associated with the brightest pixel value in each different region of the screen 102 corresponding to respective ones of the different segments 106. That is, the local baseline luminance level defines the theoretical minimum brightness of a particular segment 106 of the backlight 104 needed to adequately illuminate the brightest pixel on the display 102 associated with that particular segment 106.

Both the global and local baseline luminance levels are based on pixel values of individual pixels defined in pixel data for particular content being displayed via the screen 102. Thus, as the content rendered on the screen 102 changes, the baseline luminance levels (as well as the particular pixels of the screen 102 corresponding to such values) may change. Accordingly, in some examples, the pixel data analyzer 408 analyzes pixel data for each frame or image of content to be displayed on the screen 102 to determine the baseline luminance levels for each frame. In some examples, the pixel data analyzer 408 may analyze less than every frame or image of content (e.g., by downsampling) to increase efficiency and/or reduce processing workloads.

In some examples, the backlight analyzer 410 may also determine the full power luminance level of the display 102 of the display device 100. As used herein, the full power luminance level of the display 102 is the luminance level of the backlight 104 when operating at full power (e.g., the maximum luminance level the backlight is capable of producing). The full power luminance level may be measured in cd/m$^2$ or nits, for example. In some examples, the full power luminance level is a fixed value defined at the time of manufacture (e.g., is a manufacturing specification) based on the physical properties and/or characteristics of the backlight 104. In some such examples, the full power luminance level is included in extended display identification data (EDID) defining properties of the display 102. The EDID may be stored in memory at the time of manufacture for access by the backlight analyzer 410 to determine the full power luminance level.

In the illustrated example, the backlight analyzer 410 determines a global luminance ratio for the display 102 of the display device 100. In some examples, the backlight analyzer 410 determines the global luminance ratio based on the global baseline luminance level (e.g., the luminance level corresponding to the pixel value for the brightest pixel across the entire display 102 for the current frame of content) and the full power luminance level of the backlight 104. More particularly, the global luminance ratio corresponds to the ratio of the global baseline luminance level to the full power luminance level. As noted above, the global baseline luminance level may change from one frame to the next. Accordingly, the global luminance ratio value may also change from frame to frame as the content displayed on the screen 102 changes.

In some examples, the backlight analyzer 410 further determines a local luminance ratio associated with one or more segments 106 of the backlight 104 of the display 102 based on pixel data defining a current frame. That is, the backlight analyzer 410 determines the local luminance ratio based on the local baseline luminance level of segments 106 of the backlight 104 and the full power luminance level of the backlight 104. More particularly, the local luminance ratio corresponds to the ratio of the local baseline luminance level of the segment 106 to the full power luminance level. As noted above, the local baseline luminance level may change from one frame of content to the next. Accordingly, the local luminance ratio may also change from frame to frame as the content displayed on the screen 102 changes.

In the illustrated example of FIG. 4, the global dimming controller 412 controls the global dimming of the backlight 104 of the example display 102 of the example display device 100. As used herein, "global dimming" refers to the amount of reduction in power provided to the entire backlight 104 of the display 102 equally across all of the segments 106 of the backlight 104 (e.g., consistent reduction in power to each segment 106 of the backlight 104), thereby resulting in a reduction in the global luminance level associated with the backlight 104. The global dimming controller 500 412 includes a power saving analyzer 502 414 to determine a value for a global luminance level.

In some examples, the value for the global luminance level is determined based on a global dimming factor defined by the dimming factor determiner 402. More particularly, in the illustrated example of FIG. 4, the example dimming factor determiner 402 determines a value for a global dimming factor to control the global dimming of the backlight 104 of the example display 102 of the example display device 100. In some examples, the global dimming factor is a single byte of data with an assigned value in the range of 0-255. In some examples, the value of the global dimming factor may be converted into a strength value represented as a percentage ranging from zero to one (e.g., 0% to 100%).

The global dimming factor defines how much, if any, of a power saving opportunity is taken based on the global luminance ratio determined by the backlight analyzer 410. As used herein, a "power saving opportunity" refers to the amount of power provided to the backlight 104 in excess of the amount of power sufficient to illuminate the pixel associated with the highest pixel value across the entire display 102. That is, the power saving opportunity corresponds to the difference in power between operating the backlight 104 at the full power luminance level and operating the backlight 104 at the global baseline luminance level. Thus, in some examples, the power saving opportunity may be defined based on the global luminance ratio, which is the ratio of the global baseline luminance level to the full power luminance level as described above.

As a specific example, the pixel data analyzer 408 may analyze pixel data for a frame of content to be rendered on the display 102 and determine the global baseline luminance level is 180 cd/m$^2$ for that particular frame (e.g., the brightness of the pixel with the brightest pixel value is achieved with a luminance level of the backlight 104 being at least 180 cd/m$^2$). Further, the backlight analyzer 410 may also determine the full power luminance level of the backlight 104 is 450 cd/m$^2$. Thus, the backlight analyzer 410 receives the global baseline luminance level and the full power luminance level and determines the global luminance ratio is 40% (e.g., 180/450=0.4). That is, the global luminance ratio of 40% indicates the segment 106 corresponding to the brightest pixel of the display 102 requires a minimum of 40% of the potential backlight power (e.g., full power) of the backlight 104. Therefore, there is a 60% power saving opportunity relative to operating the backlight at full (100%) power (e.g., 60% of the backlight power is not required by the backlight 104 to provide sufficient light to illuminate the brightest pixel according to the associated pixel value defined in the pixel data for the rendered content). As indicated in the above example, in some instances, rather than expressing the amount of power corresponding to a particular power saving opportunity in watts, the power saving opportunity may be expressed as a proportion or percentage of the power provided to the backlight 104 when operating at full power.

In some examples, a global dimming factor value of zero corresponds to no power saving (0% of the power saving opportunity is taken advantage of). That is, a global dimming factor value of zero corresponds to no reduction in power provided to the backlight such that there is no reduction in the luminance level of the backlight 104 from operating at full power. In some examples, a global dimming factor of 255 indicates that power provided to the backlight 104 is reduced to take advantage of the full extent of the entire power saving opportunity (100% of the power saving opportunity is taken advantage of). That is, if the backlight needs to be at 40% of its full power to provide adequate lighting for the display (as determined by the global luminance ratio), resulting in a power saving opportunity (e.g., a strength value) of 60%, a global dimming factor value of 255 corresponds to a 60% reduction in power (relative to full power) provided to the backlight 104. Global dimming factor values between zero and 255 correspond to incremental amounts of change in the proportion of the power saving opportunity taken advantage of by the system. In some examples, the strength value between 0% and 100% may be reversed relative to the value range of the global dimming factor. That is, in some examples, a global dimming factor value of zero corresponds to taking advantage of 100% of the power saving opportunity and a global dimming factor value of 255 corresponds to taking no advantage of the power saving opportunity.

In some examples, the particular value (from 0 to 255) assigned to the global dimming factor is based on tradeoffs between power savings on the one hand and performance considerations for improved user experience on the other. While power savings are beneficial, in some situations, reducing the power too much can have undesirable effects such as screen flicker in which particular segments of the backlight may not maintain a consistent level of illumination. Another deleterious effect that can result from significantly reducing the power to the backlight is color shifting in which the color of content displayed on screen may not appear as intended by the content creator as defined in the pixel data for the content. Additionally or alternatively, significantly reducing power to the backlight for certain frames of content associated with relatively low levels of luminance can result in apparent video latency when the content suddenly changes to subsequent frames associated with higher luminance levels. That is, while a low powered backlight may be suitable for content containing relatively dark subject matter, if the content suddenly changes to include subject matter that is much brighter, there may be a delay before the backlight is powered sufficiently to provide adequately lighting for the new content. Thus, there are reasons to not always take advantage of the full extent of a power saving opportunity at any given point in time.

In some examples, the particular value assigned to the global dimming factor (defining the proportion of a power saving opportunity that is realized by dimming the backlight 104) is based on an analysis of one or more of the luminance factors, such as data from other components of the display device 100 and/or a user of the display device 100. That is, in some examples, the dimming factor determiner 402 receives one or more of the usage data, the ambient lighting data, and the user input data. In some examples, the dimming factor determiner 402 receives the ambient lighting data indicating that there is no ALS 308 associated with the display device 100 and/or that the ALS 308 is not currently active to provide ambient lighting data indicative of the ambient lighting conditions of the surrounding environment. For example, the dimming factor determiner 402 may use the usage data associated with the display device 100 to set the global dimming factor. For example, video player applications may involve relatively high luminance levels and/or a relatively high degree of variability in the luminance levels, and thus, a global dimming factor associated with less global dimming (e.g., less power savings). By contrast, typical office applications (e.g., word processing) typically involve relatively low luminance levels that are more consistent over time, such that a global dimming factor corresponding to taking advantage of a greater fraction of a power saving opportunity may be appropriate. In some examples, the dimming factor determiner 402 may similarly use ambient lighting data to set the global dimming factor. For example, when the ambient lighting is relatively dark, a global dimming factor that takes advantage of a greater proportion of a power saving opportunity (e.g. dims the backlight to a greater extent) because a user will be able to perceive the light in the relatively dark environment. By contrast, when the ambient lighting is relatively light, a global dimming factor that takes less advantage of power saving opportunities may be specified to increase visibility of the content displayed on the screen. Additionally or alternatively, the dimming factor determiner 402 may assign a particular value to the global dimming factor based on user input data. That is, in some examples, the global dimming factor may be tuned according to user preference to allow the user to control the tradeoff between increased power savings and the potential results of undesirable screen effects. For instance, in some examples, a user may manually dim the backlight 104 resulting in a global dimming factor that takes advantage of a greater proportion of a power saving opportunity.

As mentioned above, in the illustrated example of FIG. 4, the power saving analyzer 414 determines the global luminance level of the backlight 104 based on the global dimming factor and the global luminance ratio. That is, the power saving analyzer 414 determines a luminance level (e.g., the intensity of emitted light) of the backlight 104 based on how much of a power saving opportunity is available (e.g., based on the global luminance ratio) and based on how much of such power saving opportunity is to be realized (e.g., based on the global dimming factor).

In the illustrated example, the global dimming strength database 416 stores the global dimming factor value determined by the dimming factor determiner 402. In some examples, the stored global dimming factor value may be used to determine whether to update the global dimming of the display device 100. That is, unlike the baseline luminance levels for individual pixels on the display that are determined at each frame, the global dimming of the display device 100 may be set and maintained at the same value until it is to be updated in response to changes in global dimming factors and/or pixel data. For example, the usage data may indicate the display device 100 is to be used to playback a video. In such examples, the pixel data analyzer 408 determines the luminance levels of the segments 106 of the backlight 104 for each frame of content (e.g., each frame of the video). By contrast, the global dimming factor is determined once and remains the same (e.g., stored in the global dimming strength database 416) during the entire playback of the video because there is no change to the usage of the display device 100. However, once the user input data indicates a change of usage, the power saving analyzer 414 may determine to update the global dimming factor based on the new context (e.g., a new usage associated with word processing instead of playing a video). Additionally or alternatively, in some examples, a change in ambient light data, and/or a user input data may trigger the power saving analyzer 414 to determine an updated value for the global dimming factor. Further, the power saving analyzer 414 may check the existing global dimming factor value stored in the global dimming strength database 416 in response to determining a second global dimming factor value. In some examples, the power saving analyzer 414 determines not to update the global dimming factor of the display device 100 if the second global dimming factor value is within a certain tolerance interval. The example global dimming strength database 416 is implemented by any memory, storage device and/or storage disc for storing data such as, for example, flash memory, magnetic media, optical media, solid state memory, hard drive(s), thumb drive(s), etc. Furthermore, the data stored in the global dimming strength database 416 may be in any data format such as, for example, binary data, comma delimited data, tab delimited data, SQL structures, etc.

Figure 5:
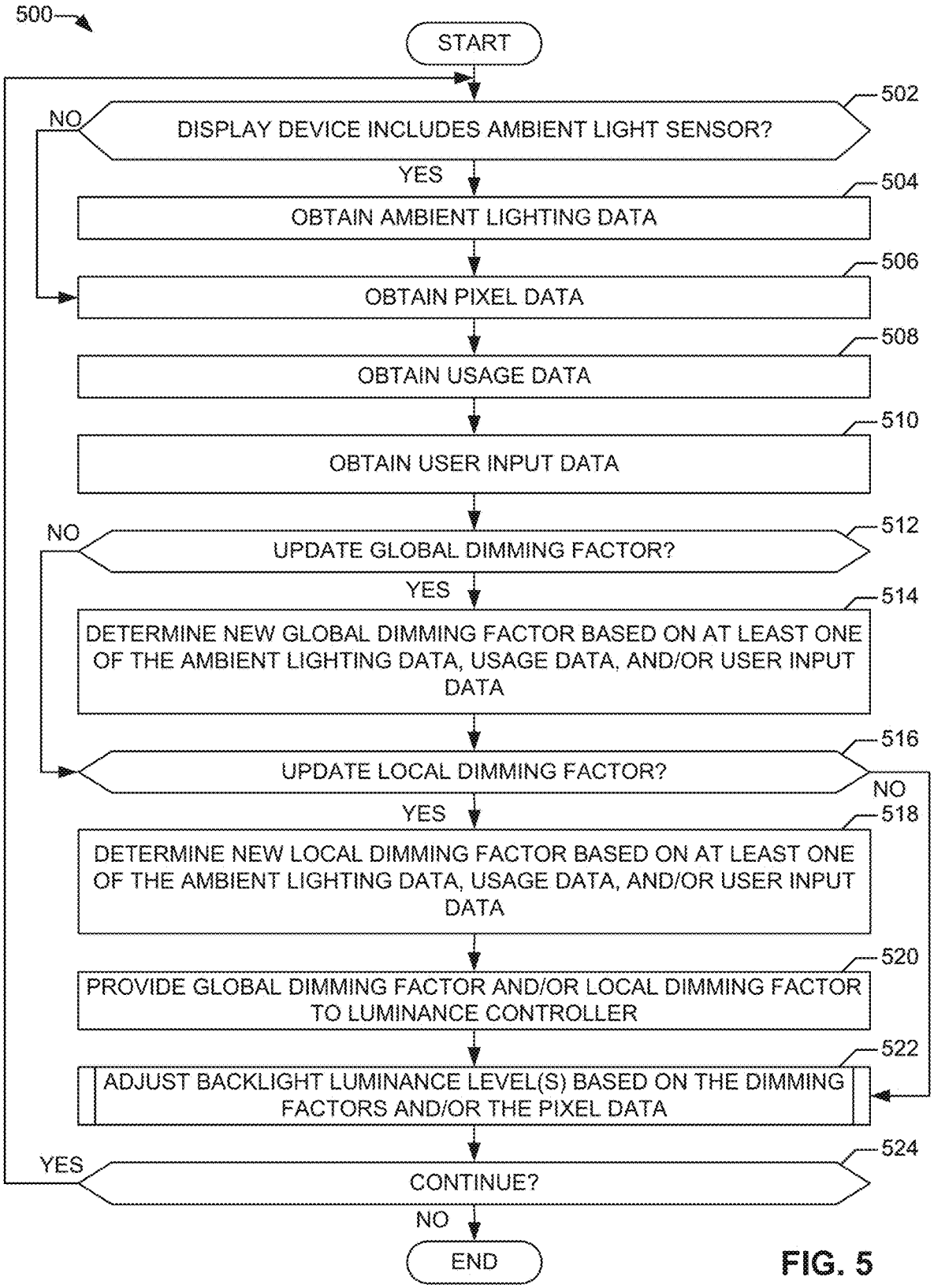
FIGS. 5-6 are flowcharts representative of example machine readable instructions that may be executed to implement the example luminance management system of FIG. 3.

In the illustrated example of FIG. 5, the local dimming controller 450 controls the local dimming of one or more segments 106 of the example backlight 104 of the example display device 100. In this example, the local dimming controller 450 includes a segment-pair ratio analyzer 452. The segment-pair ratio analyzer 452 determines different segment-pair luminance ratios for different pairs of adjacent segments 106 of the backlight 104. In some examples, the segment-pair ratio analyzer 452 determines a segment-pair luminance ratio for a particular pair of segments 106 based on the local luminance ratios determined by the backlight analyzer 410 for each of the segments 106 in the particular pair of segments 106 being analyzed. More particular, the segment-pair luminance ratio corresponds to the ratio of the first local luminance ratio associated with the first segment in the pair to the second local luminance ratio associated with the second segment in the pair. For example, the backlight analyzer 410 may determine a first segment 106 of the backlight 104 has a first local luminance ratio of 90% (e.g., the local baseline luminance level is 405 cd/m$^2$ and the full power luminance level of the backlight 104 is 450 cd/m$^2$, thus, the local luminance ratio is 405/450=0.9). As described above with respect to the global luminance ratio, a local luminance ratio of 90% indicates that there is a power saving opportunity (of 10%) because only 90% of the first segment 106 at full power is needed to provide adequate light to illuminate pixels within the corresponding region of the display based on the current pixel data. Further, the backlight analyzer 410 may determine a second segment 106 (e.g., adjacent to the first segment 106) has a second local luminance ratio of 20% (e.g., the local baseline luminance level of the second segment 106 is 90 cd/m$^2$ and the full power luminance level of the backlight 104 is 450 cd/m$^2$, thus, the local luminance ratio is 90/450=0.2). The local luminance ratio 20% of the second segment 106 indicates that there is a power saving opportunity of 80% with respect to the power provided to the second segment 106. Based on the above example, the segment-pair ratio analyzer 452 determines the segment-pair luminance ratio between the first and second segments 106 is 4.5 (e.g., 0.9/0.2).

In the above example, the segment-pair luminance ratio is calculated with the smaller local luminance ratio in the pair being used as the denominator. In such examples, the segment-pair luminance ratio will always be equal to or greater than 1. In other examples, the larger local luminance ratio is used as the denominator such that the resulting segment-pair luminance ratio is always less than or equal to 1. In other examples, a separate segment-pair luminance ratio is calculated for each segment in the pair with the numerator and denominator inverted for each segment. Thus, for example, the segment-pair luminance ratio for the first segment in the above example is 0.9/0.2=4.5, whereas the segment-pair luminance ratio for the second segment in the above example is 0.2/0.9=0.22. Whether the two segments 106 in a particular pair are assigned the same segment-pair luminance ratio or a different segment-pair luminance ratio, it is likely that there will be circumstances where the segment-pair luminance ratio between the first segment and a third segment is different than the ratio between the first and second segments. That is, inasmuch as any particular segment may be adjacent more than one other segment, it is possible that the particular segment will be associated with multiple different segment-pair luminance ratios (one ratio for each pair of adjacent segments the particular segment belongs to). In some examples, each of the different segment-pair luminance ratios is stored for the particular segment. In other examples, only the segment-pair luminance ratio exhibiting the largest difference between the corresponding pair of segments (e.g., highest ratio above 1 and/or lowest ratio below 1) is assigned to the particular segment.

In the illustrated example, the backlight ratio analyzer 454 determines the local luminance level of one or more segments 106 of the backlight 104. In some examples, the value for the local luminance level is determined based on a local dimming factor defined by the dimming factor determiner 402. More particularly, in the illustrated example of FIG. 4, the example dimming factor determiner 402 determines a value for a local dimming factor to control the local dimming of one or more segments 106 of the example backlight 104 of the example display device 100.

In the illustrated example, the dimming factor determiner 402 sets a value for a local dimming factor. In some examples, the local dimming factor is a value assigned to a single byte of data with an assigned value in the range of 0-255. In some examples, the value of the local dimming factor may be converted into a strength value represented as a percentage ranging from zero to one (e.g., 0% to 100%). The local dimming factor determines how much, if any, adjacent segments 106 of the backlight 104 may differ in luminance level as controlled by differences in the amount of power providing to each segment. That is, the local dimming factor defines a limit or threshold on the segment-pair luminance ratio between two adjacent segments 106.

In some examples, the range of possible values (e.g., 0-255) for the local dimming factor includes both a percentage differential range and a multiplier differential range. In some such examples, the percentage differential range includes a plurality of different values for the local dimming factor that correspond to incremental portions of a percentage difference in luminance level between adjacent segments ranging from 0% (e.g., no difference in luminance level) to 100% (e.g., a first segment is limited to a luminance level that is twice (e.g., 1 times greater than) a second segment). In some examples, the percentage differential range corresponds to values from 0 to 100 of the possible values (0 to 255) for the one-byte local dimming factor. In other words, in some examples, a local dimming factor value of zero corresponds to no power differential between adjacent segments 106 of the backlight 104 (e.g., local dimming is disabled). By contrast, a local dimming factor value of 100 enables up to 100% more power provided to a first segment 106 than is provided to a respective adjacent segment 106, thereby enabling the luminance level of the first segment 106 to be up to one times brighter than (e.g., twice as bright as) the adjacent segment 106. Thus, local dimming factor of 100 corresponds to a limit or threshold of 2 to the segment-pair luminance ratio between two adjacent segments 106, where the smaller local luminance ratio is in the denominator, and a limit or threshold of 0.5 to the local luminance ratio, where the smaller local luminance ratio is in the numerator. That is, to use the example outlined above, the segment-pair luminance ratio of 4.5 (based on a first local luminance ratio of 90% and a second local luminance ratio of 20%) would not be allowed when the local dimming factor is set to a value corresponding to 100% on the percentage differential range (e.g., the 1-byte value is set to 100 in the above example) because 4.5 is greater than the threshold limit of 2. In some such examples, the threshold limit is satisfied by lessening the proportion of power saving opportunities that are taken advantage of with respect to the segment 106 associated with a smaller local luminance ratio (here the second segment with a local luminance ratio of 20%). That is, the power provided to the second segment 106 of the backlight 104 is controlled to be more than the minimum 20% of full power needed to sufficiently illuminate pixels in the corresponding region of the display 102 based on the associated pixel data. More particularly, the minimum power at which the second segment 106 may operate to satisfy the threshold limit of 2 based on the local dimming factor value, outlined in the above example, is 45% of full power (e.g., a 55% power saving) because that is one half of the 90% of full power needed for the first segment.

As mentioned above, in some examples, the range of possible values (e.g., 0-255) for the local dimming factor includes a multiplier differential range. In some such examples, the multiplier differential range includes a plurality of different values for the local dimming factor that correspond to different numbers of times the luminance level for one segment 106 (or the corresponding numbers of times the amount of power provided to the segment) may be greater than for an adjacent segment 106. In some examples, the different numbers of times represented by the different values for the local dimming factor within the multiplier differential range correspond to luminance levels for a first segment 106 that range from 1 times greater (e.g., no difference) to 100 times greater than an adjacent segment. In some examples, these different numbers of times (e.g., multipliers) correspond to values from 101 to 200 of the possible values (0 to 255) for the local dimming factor. In this manner, both the percentage differential range (e.g., byte values from 0-100) and the multiplier differential range (e.g., byte values from 101-200) may be assigned to the local dimming factor represented by a single byte of data. In some examples, the number of values for the single byte of date associated with either of the percentage differential range or the multiplier differential range may be more or less than the 100 values outlined above and/or corresponding to different portions of the possible values for the local dimming factor (e.g., the multipliers may correspond to values 0-49 and the percentages may correspond to byte values of 50-249). Further, in some examples, increasing byte values in the percentage differential range and/or the multiplier differential range may correspond to incrementally decreasing percentages and/or multipliers.

In some examples, one value for the single byte local dimming factor (e.g., the value of 255) is designated to correspond to an unrestricted differential in backlight power (or corresponding luminance level) between adjacent segments 106 of the backlight 104. That is, a local dimming factor value of 255 (or whatever other value may be designated for the unrestricted differential) does not limit the power differential between adjacent segments 106 of the backlight 104 such that the luminance levels of the adjacent segments 106 can differ by any extent up to the physical limitations of the underlying hardware (e.g., one segment is fully powered while the adjacent segment is not powered at all).

In some examples, the particular value assigned to the local dimming factor (whether in the percentage differential range, in the multiplier differential range, or corresponding to the unrestricted differential) is based on analysis of one or more of the luminance factors in a similar manner that such factors contribute to the determination of the global dimming factor as outlined above. For example, the dimming factor determiner 402 may use the display device 100 usage data to determine whether the device is being used for video playback, for basic office applications, or some other type of usage. Based on the usage data, the dimming factor determiner 402 sets the local dimming factor to account for anticipated luminance needs (including possible contrast between different portions of content) on the one hand while also reducing (e.g., minimizing) the appearance of halos resulting from segments operating at different luminance levels on the other hand. For example, video player applications may involve content associated with a relatively high range of pixel values (e.g., a variety of colors, use of both bright and dark pixels). Thus, a relatively large range of luminance levels between adjacent segments 106 of the backlight 104 would facilitate the visual rendering of the content. Therefore, the dimming factor determiner 402 may determine a local dimming factor value in the multiplier differential range (e.g., allow a relatively larger power differential between adjacent segments 106 of the backlight 104). By contrast, typical office applications (e.g., word processing) typically involve relatively consistent pixel data with less high-contrast extremes and, thus, similar luminance levels for the different segments 106. As such, a lower local dimming factor (corresponding to limiting the segment-pair luminance ratio) may be appropriate in such circumstances.

As mentioned above, the likelihood of visible halos appearing on a screen increases as the difference in luminance level between adjacent backlight segments 106 increase. Thus, while setting the local dimming factor to a value corresponding to a higher limit on the segment-pair luminance ratio may result in more contrast and more power savings, it may also increase the likelihood and/or intensity of halos on the display 102. Accordingly, in some examples, the particular value assigned to the local dimming factor is based on user input data to enable the user to specify the level of halo effects that are tolerable and/or the level of contrast and power savings that the user desires. That is, the local dimming factor may reflect user preference regarding halos and power savings. For example, a default value of the local dimming factor may be within the percentage multiplier range. In some examples, a local dimming factor value within the percentage multiplier range minimizes halos but also limits the contrast ratio between pixels of the example display 102. User input may update the local dimming factor to be within the multiplier differential range and thus, allow a relatively high segment-pair luminance ratio. This may indicate that the user prefers a higher contrast between pixels of the example display 102 compared to minimizing halos.

As mentioned above, the backlight ratio analyzer 454 determines and/or updates the luminance level (e.g., the intensity of emitted light) of one or more segment(s) 106 of the backlight 104 based on the local dimming factor, the local luminance ratio of two or more segments 106, and the segment-pair luminance ratio associated with pairs of the two or more segments 106. That is, the backlight ratio analyzer 454 determines a luminance level (e.g., the intensity of emitted light) of a particular segment 106 based on the difference in amount of light needed to sufficiently illuminate the brightest pixel in the segment 106 relative to adjacent segments (e.g., defined by the segment-pair luminance ratio) and based on any limits to this differential defining the amount of contrast between the adjacent segments that may be realized (e.g., based on the local dimming factor). In some examples, the backlight ratio analyzer 454 determines whether the segment-pair luminance ratio associated with two adjacent segments 106 satisfies the threshold corresponding to the value set for the local dimming factor. As described above, halos occur when there is a difference in luminance level between adjacent segments 106 of the backlight 104. Accordingly, in some examples, the backlight ratio analyzer 454 compares the segment-pair luminance ratio determined by the segment-pair ratio analyzer 452 to the local dimming factor stored in example local dimming strength database 456 to determine whether an unacceptable halo is likely present (e.g., when the segment-pair luminance ratio satisfies (e.g., exceeds) the threshold defined by the local dimming factor).

In the illustrated example, the local dimming strength database 456 stores the local dimming factor value determined by the dimming factor determiner 402. In some examples, the stored local dimming factor value may be used to determine whether to update the local dimming of the display device 100. That is, like the global dimming of the display device 100, in some examples, the local dimming may be set and maintained at the same value until changes in a local dimming factor and/or pixel data trigger a need to update and/or revise the local dimming factor. Further, the backlight ratio analyzer 454 may check the existing local dimming factor value stored in the local dimming strength database 456 in response to a change in context and the resulting determination of a second (new) local dimming factor value. In some examples, the backlight ratio analyzer 454 determines not to update the local dimming of the display device 100 if the second local dimming factor value is within a certain tolerance interval. The example local dimming strength database 456 is implemented by any memory, storage device and/or storage disc for storing data such as, for example, flash memory, magnetic media, optical media, solid state memory, hard drive(s), thumb drive(s), etc. Furthermore, the data stored in the local dimming strength database 456 may be in any data format such as, for example, binary data, comma delimited data, tab delimited data, SQL structures, etc.

While an example manner of implementing the luminance management system 312 of FIG. 3 is illustrated in FIG. 4, one or more of the elements, processes and/or devices illustrated in FIG. 4 may be combined, divided, re-arranged, omitted, eliminated and/or implemented in any other way. Further, the example dimming factor determiner 402, the example interface 404, the example luminance controller 406 (including the example pixel data analyzer 408, the example backlight analyzer 410, the example global dimming controller 412 (including the example power saving analyzer 414 and the example global dimming strength database 416), and the example local dimming controller 450 (including the example segment-pair ratio analyzer 452, the example backlight ratio analyzer 454, and the example local dimming strength database 456)) and/or, more generally, the example luminance management system 312 of FIG. 4 may be implemented by hardware, software, firmware and/or any combination of hardware, software and/or firmware. Thus, for example, any of the example dimming factor determiner 402, the example interface 404, the example luminance controller 406 (including the example pixel data analyzer 408, the example backlight analyzer 410, the example global dimming controller 412 (including the example power saving analyzer 414 and the example global dimming strength database 416), and the example local dimming controller 450 (including the example segment-pair ratio analyzer 452, the example backlight ratio analyzer 454, and the example local dimming strength database 456)) and/or, more generally, the example luminance management system 312 of FIG. 4 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example dimming factor determiner 402, the example interface 404, the example luminance controller 406 (including the example pixel data analyzer 408, the example backlight analyzer 410, the example global dimming controller 412 (including the example power saving analyzer 414 and the example global dimming strength database 416), and the example local dimming controller 450 (including the example segment-pair ratio analyzer 452, the example backlight ratio analyzer 454, and the example local dimming strength database 456)) is/are hereby expressly defined to include a non-transitory computer readable storage device or storage disk such as a memory, a digital versatile disk (DVD), a compact disk (CD), a Blu-ray disk, etc. including the software and/or firmware. Further still, the example luminance management system 312 of FIG. 3 may include one or more elements, processes and/or devices in addition to, or instead of, those illustrated in FIG. 4, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 6:
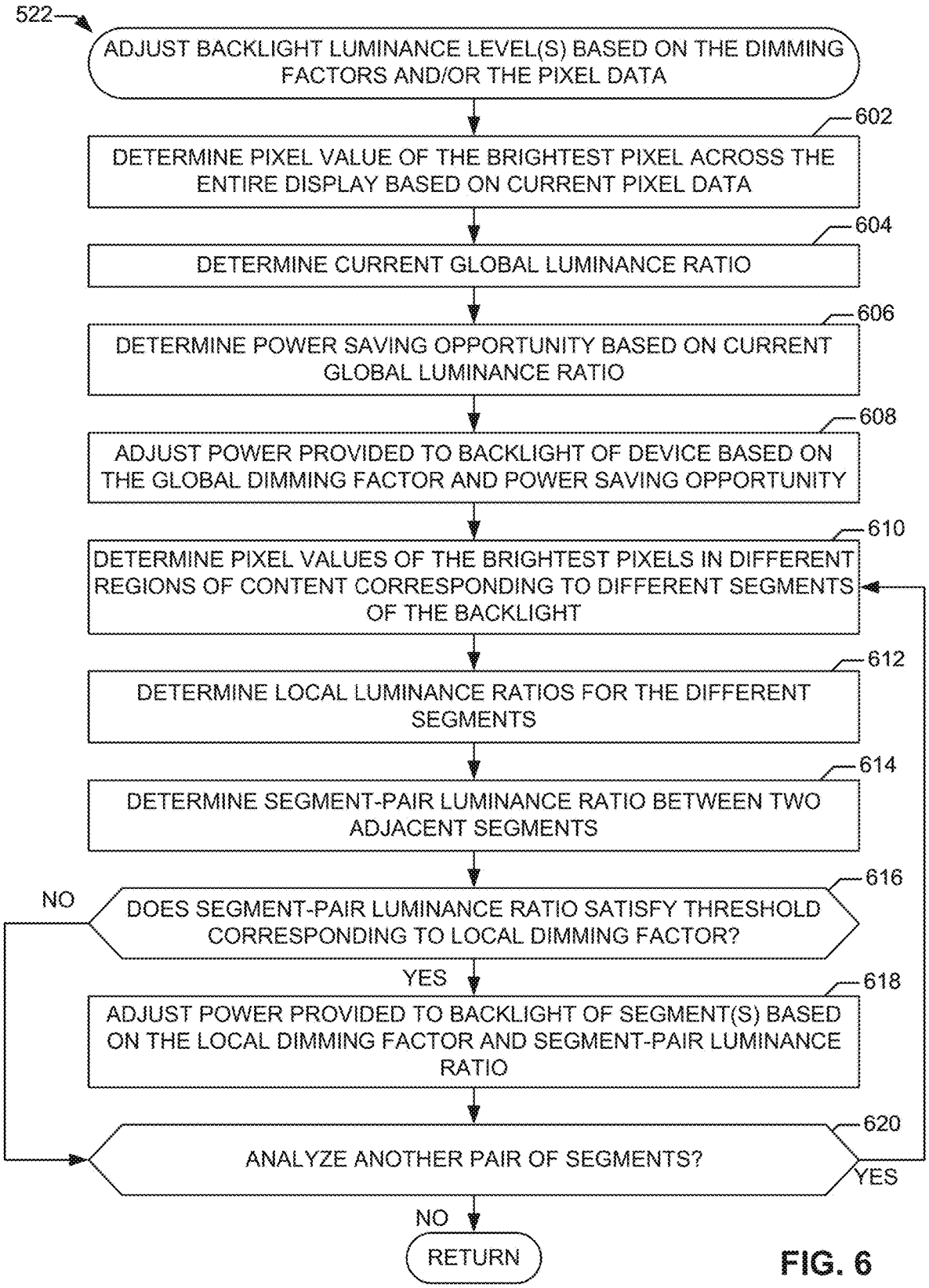

A flowchart representative of example hardware logic, machine readable instructions, hardware implemented state machines, and/or any combination thereof for implementing the luminance management system 312 of FIG. 3 is shown in FIGS. 5-6. The machine readable instructions may be one or more executable programs or portion(s) of an executable program for execution by a computer processor such as the processor 712 shown in the example processor platform 700 discussed below in connection with FIG. 7. The program may be embodied in software stored on a non-transitory computer readable storage medium such as a CD-ROM, a floppy disk, a hard drive, a DVD, a Blu-ray disk, or a memory associated with the processor 712, but the entire program and/or parts thereof could alternatively be executed by a device other than the processor 712 and/or embodied in firmware or dedicated hardware. Further, although the example program is described with reference to the flowcharts illustrated in FIGS. 5-6, many other methods of implementing the example luminance management system 312 of FIG. 3 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

The machine readable instructions described herein may be stored in one or more of a compressed format, an encrypted format, a fragmented format, a compiled format, an executable format, a packaged format, etc. Machine readable instructions as described herein may be stored as data (e.g., portions of instructions, code, representations of code, etc.) that may be utilized to create, manufacture, and/or produce machine executable instructions. For example, the machine readable instructions may be fragmented and stored on one or more storage devices and/or computing devices (e.g., servers). The machine readable instructions may require one or more of installation, modification, adaptation, updating, combining, supplementing, configuring, decryption, decompression, unpacking, distribution, reassignment, compilation, etc. in order to make them directly readable, interpretable, and/or executable by a computing device and/or other machine. For example, the machine readable instructions may be stored in multiple parts, which are individually compressed, encrypted, and stored on separate computing devices, wherein the parts when decrypted, decompressed, and combined form a set of executable instructions that implement a program such as that described herein.

In another example, the machine readable instructions may be stored in a state in which they may be read by a computer, but require addition of a library (e.g., a dynamic link library (DLL)), a software development kit (SDK), an application programming interface (API), etc. in order to execute the instructions on a particular computing device or other device. In another example, the machine readable instructions may need to be configured (e.g., settings stored, data input, network addresses recorded, etc.) before the machine readable instructions and/or the corresponding program(s) can be executed in whole or in part. Thus, the disclosed machine readable instructions and/or corresponding program(s) are intended to encompass such machine readable instructions and/or program(s) regardless of the particular format or state of the machine readable instructions and/or program(s) when stored or otherwise at rest or in transit.

The machine readable instructions described herein can be represented by any past, present, or future instruction language, scripting language, programming language, etc. For example, the machine readable instructions may be represented using any of the following languages: C, C++, Java, C#, Perl, Python, JavaScript, HyperText Markup Language (HTML), Structured Query Language (SQL), Swift, etc.

As mentioned above, the example processes of FIGS. 6-7 may be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

The program 500 of FIG. 5 begins at block 502 where the example dimming factor determiner 402 determines whether the display device 100 includes an ambient light sensor. If the display device 100 includes an ambient light sensor, control advances to block 504 where the example dimming factor determiner 402 obtains ambient lighting data (e.g., from the ambient light sensor(s) 308). Thereafter, control advances to block 506. Returning to block 502, if the example dimming factor determiner 402 determines that the display device 100 does not include an ambient light sensor, control advances directly to block 506 where the example pixel data analyzer 408 obtains pixel data defining content to be rendered via the display 102.

At block 508, the example dimming factor determiner 402 obtains usage input data. At block 510, the example dimming factor determiner 402 obtains user input data. In some examples, when the process of FIG. 5 first commences, the current global and local dimming factors may correspond to default values. However, as time advances and the display device iterates through the example process, the current dimming factors may be updated as described further below. In particular, at block 512, the example dimming factor determiner 402 determines whether to update the global dimming factor. In some examples, the example dimming factor determiner 402 updates the global dimming factor in response to a change in the ambient lighting data, the user input data, and/or the usage data. For example, in response to an increase in ambient light, the example dimming factor determiner 402 may determine to update the global dimming factor to brighten the display. If the example dimming factor determiner 402 determines to update the global dimming factor, control advances to block 514 where the example dimming factor determiner 402 determines a new global dimming factor based on at least one of the ambient lighting data, usage data, and/or user input data. For example, the example dimming factor determiner 402 may determine a relatively low global dimming factor (e.g., a relatively low amount of the power saving opportunity is taken) based on ambient lighting data indicating relatively bright ambient light conditions. In some examples, the example global dimming controller 412 stores the new global dimming factor in the example global dimming strength database 416. Thereafter, control proceeds to block 516. Returning to block 512, if the example dimming factor determiner 402 determines not to update the global dimming factor, control proceeds directly to block 516.

At block 516, the example dimming factor determiner 402 determines whether to update the local dimming factor. In some examples, the example dimming factor determiner 402 updates the local dimming factor in response to a change in the ambient lighting data, usage data and/or user input data. For example, the example dimming factor determiner 402 may determine to update the local dimming factor in response to a change in usage application from a word processor to a video player. If the example dimming factor determiner 402 determines to update the local dimming factor, control advances to block 518 where the example dimming factor determiner 402 determines a new local dimming factor based on at least one of the ambient lighting data, usage data, and/or user input data. For example, usage data may indicate a change from a word processing application to a video player application. The example dimming factor determiner 402 may determine a new local dimming factor in the multiplier differential range (e.g., allow a relatively high segment-pair luminance ratio and thus, greater contrast) based on the usage data. In some examples, the example local dimming controller 450 stores the new local dimming factor in the example local dimming strength database 456. Thereafter, control advances to block 520. Returning to block 516, if the example dimming factor determiner 402 determines not to update the local dimming factor, control proceeds directly to block 520.

At block 520, the example interface 404 provides the global dimming factor and/or the local dimming factor to the example luminance controller 406. At block 522, the example luminance controller 406 adjusts the backlight luminance level(s) based on the dimming factors and/or the pixel data. Additional details associated with the subprocess 522 are described below in relation to FIG. 6. At block 524, the example program determines whether to continue. If so, control returns to block 502. Otherwise, the example program 500 of FIG. 5 ends.

As mentioned above, an example implementation of the subprocess 522 of FIG. 5 is illustrated in FIG. 6. As shown in the illustrated example of FIG. 6, the subprocess 522 begins at block 602 where the example pixel data analyzer 408 determines the pixel value of the brightest pixel across the entire display 102 based on the current pixel data (e.g., associated with the current frame to be rendered via the display 102). At block 604, the example backlight analyzer 410 determines the current global luminance ratio. That is, the example backlight analyzer 410 determines the ratio of the global baseline luminance level (e.g., corresponding to the pixel value of the brightest pixel determined at block 602) to the full power luminance level of the backlight 104. At block 606, the example power saving analyzer 414 determines the power saving opportunity based on the current global luminance ratio.

At block 608, the example power saving analyzer 414 adjusts the power provided to the example backlight 104 of the display device 100 based on the global dimming factor and the power saving opportunity. That is, the power saving analyzer 414 reduces the power provided to all segments 106 of the backlight 104 by the proportion of the power saving opportunity defined by the global dimming factor. For instance, if the global dimming factor defines a strength value of 40%, then 40% of the power saving opportunity is taken.

At block 610, the example pixel data analyzer 408 determines the pixel values of the brightest pixels in different regions of content corresponding to different segments 106 of the backlight 104. That is, the example pixel data analyzer 408 determines pixel values corresponding to the local baseline luminance level for the different segments 106 of the backlight 104. At block 612, the example backlight analyzer 410 determines the local luminance ratios for the different segments 106. The example backlight analyzer 410 determines the local luminance ratios based on the local baseline luminance level associated with each segment (e.g., corresponding to the pixel value of the brightest pixel in the different regions of content determined at block 610) and the full power luminance level of the backlight 104. At block 614, the example segment-pair ratio analyzer 452 determines a segment-pair luminance ratio between two adjacent segments 106. In some examples, the segment-pair luminance ratio is the ratio between the local luminance ratios of the two adjacent segments 106.

At block 616, the example backlight ratio analyzer 454 determines whether the segment-pair luminance ratio satisfies the threshold corresponding to the local dimming factor. That is, the example backlight ratio analyzer 454 determines whether a halo is likely. If the example backlight ratio analyzer 454 determines the segment-pair luminance ratio satisfies (e.g., exceeds) the threshold corresponding to the local dimming factor, control advances to block 618 where the example backlight ratio analyzer 454 adjusts the power provided to the backlight 104 of segment(s) 106 based on the local dimming factor and segment-pair luminance ratio. In some examples, the example backlight ratio analyzer 454 increases the power level to the segment 106 with the lower local luminance level in the pair to satisfy the threshold corresponding to the local dimming factor. Thereafter, control proceeds to block 620. Returning to block 616, if the example backlight ratio analyzer 454 determines the segment-pair luminance ratio does not satisfy the threshold corresponding to the local dimming factor, control advances to block 620. At block 620, the example local dimming controller 450 determines whether to analyze another pair of segments 106. If the example local dimming controller 450 determines to analyze another pair of segments 106, control returns to block 610. Otherwise, the example subprocess 522 of FIG. 6 ends and control returns to block 524 of the example program 500 of FIG. 5.

Figure 7:
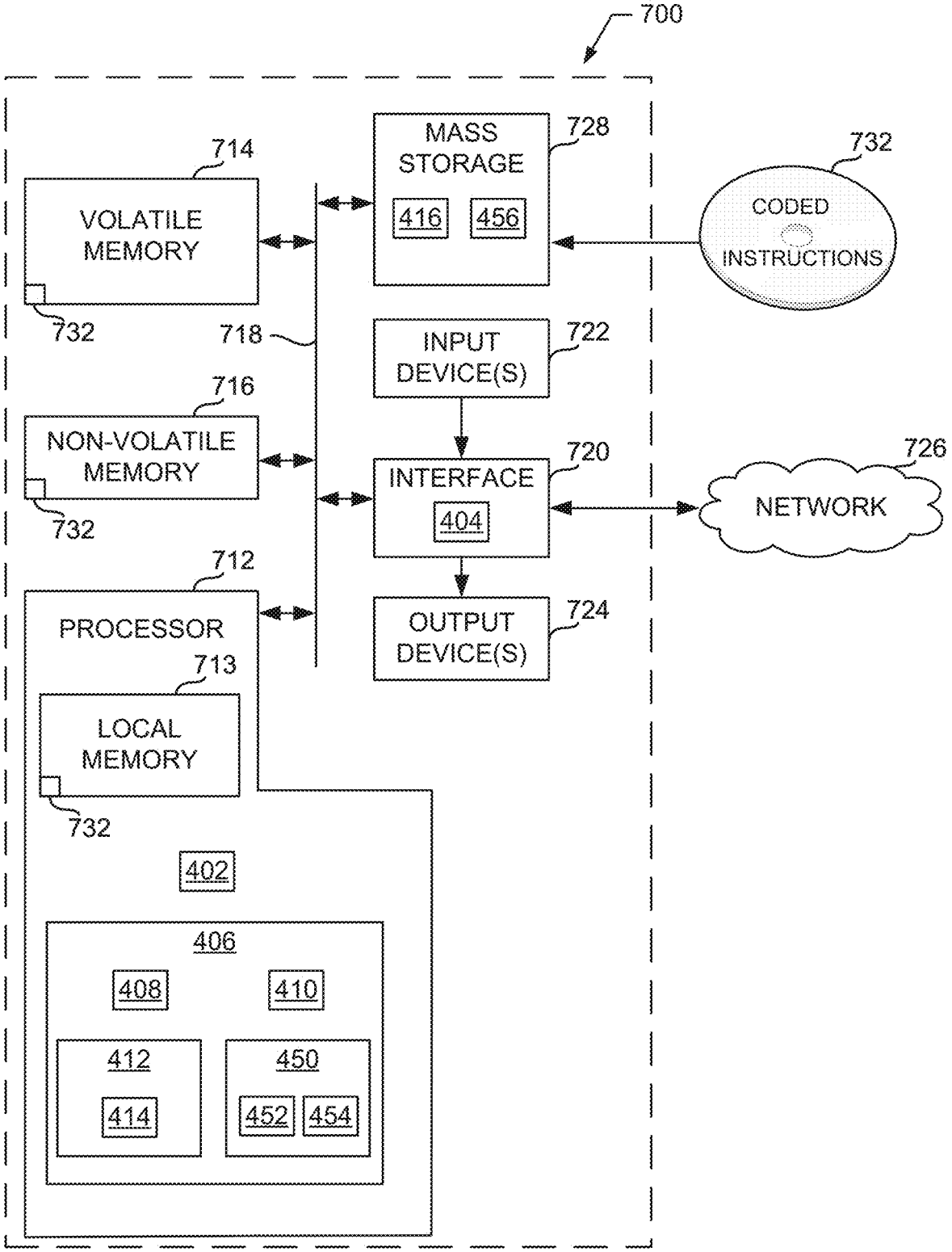
FIG. 7 is a block diagram of an example processing platform structured to execute the example instructions of FIGS. 6-7 to implement the example luminance management system of FIG. 3.

FIG. 7 is a block diagram of an example processor platform 700 structured to execute the instructions of FIGS. 5-6 to implement the luminance management system 312 of FIG. 4. The processor platform 700 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, a headset or other wearable device, or any other type of computing device.

The processor platform 700 of the illustrated example includes a processor 712. The processor 712 of the illustrated example is hardware. For example, the processor 712 can be implemented by one or more integrated circuits, logic circuits, microprocessors, GPUs, DSPs, or controllers from any desired family or manufacturer. The hardware processor may be a semiconductor based (e.g., silicon based) device. In this example, the processor implements the example dimming factor determiner 402, the example luminance controller 406 (including the example pixel data analyzer 408, the example backlight analyzer 410, the example global dimming controller 412 (including the example power saving analyzer 414) and the example local dimming controller 450 (including the example segment-pair ratio analyzer 452 and the example backlight ratio analyzer 454)).

The processor 712 of the illustrated example includes a local memory 713 (e.g., a cache). The processor 712 of the illustrated example is in communication with a main memory including a volatile memory 714 and a non-volatile memory 716 via a bus 718. The volatile memory 714 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 716 may be implemented by flash memory and/or any other desired type of memory device. Access to the main memory 714, 716 is controlled by a memory controller.

The processor platform 700 of the illustrated example also includes an interface circuit 720. The interface circuit 720 may be implemented by any type of interface standard, such as an Ethernet interface, a universal serial bus (USB), a Bluetooth® interface, a near field communication (NFC) interface, and/or a PCI express interface.

In the illustrated example, one or more input devices 722 are connected to the interface circuit 720. The input device(s) 722 permit(s) a user to enter data and/or commands into the processor 712. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 724 are also connected to the interface circuit 720 of the illustrated example. The output devices 724 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer and/or speaker. The interface circuit 720 of the illustrated example, thus, typically includes a graphics driver card, a graphics driver chip and/or a graphics driver processor.

The interface circuit 720 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 726. The communication can be via, for example, an Ethernet connection, a digital subscriber line (DSL) connection, a telephone line connection, a coaxial cable system, a satellite system, a line-of-site wireless system, a cellular telephone system, etc.

The processor platform 700 of the illustrated example also includes one or more mass storage devices 728 for storing software and/or data. Examples of such mass storage devices 728 include floppy disk drives, hard drive disks, compact disk drives, Blu-ray disk drives, redundant array of independent disks (RAID) systems, and digital versatile disk (DVD) drives.

The machine executable instructions 732 of FIGS. 5-6 may be stored in the mass storage device 728, in the volatile memory 714, in the non-volatile memory 716, and/or on a removable non-transitory computer readable storage medium such as a CD or DVD.

From the foregoing, it will be appreciated that example methods, apparatus and articles of manufacture have been disclosed that manage display luminance to improve power efficiency (e.g., battery life) and reduce undesirable visible screen effects (e.g., halos). Power efficiency is achieved by determining a backlight luminance level for the entire display backlight and/or individual segments of the display backlight that identify power saving opportunities available by reducing power to the entire display and/or power to individual segments. Reducing the presence of halo effects is achieved by determining suitable threshold limits for differences in luminance levels for adjacent segments of the backlight and controlling the power provided to such segments to maintain the power differences to within the specified threshold limits. The disclosed methods, apparatus and articles of manufacture are accordingly directed to one or more improvement(s) in the functioning of a computer.

Example methods, apparatus, systems, and articles of manufacture to manage display luminance are disclosed herein. Further examples and combinations thereof include the following:

Example 1 includes an apparatus comprising a backlight analyzer to determine a first baseline luminance level associated with a first segment of a backlight of a screen of a display device based on pixel data defining a frame of content to be displayed via the screen, and determine a second baseline luminance level associated with a second segment of the backlight different than the first segment based on the pixel data, and a segment-pair ratio analyzer to determine a segment-pair luminance ratio between the first and second segments based on the first and second baseline luminance levels, and a luminance controller to adjust an amount of power provided to at least one of the first segment of the backlight or the second segment of the backlight when the segment-pair luminance ratio satisfies a threshold.

Example 2 includes the apparatus of example 1, wherein the first and second segments are adjacent to one another.

Example 3 includes the apparatus of example 1, wherein the backlight analyzer is to determine the first baseline luminance level based on a brightest pixel value in the pixel data corresponding to a first region of the frame associated with the first segment, and determine the second baseline luminance level based on a brightest pixel value in the pixel data corresponding to a second region of the frame associated with the second segment.

Example 4 includes the apparatus of example 1, further including a backlight ratio analyzer to determine a value for a local dimming factor, the threshold defined based on the local dimming factor.

Example 5 includes the apparatus of example 4, wherein the value is within a range of potential local dimming factor values, different ones of the potential local dimming factor values to indicate respective ones of different limits on the segment-pair luminance ratio between the first and second segments.

Example 6 includes the apparatus of example 5, wherein the different limits include a range of percentage differentials ranging from a 0 percent difference to a 100 percent difference.

Example 7 includes the apparatus of example 5, wherein the different limits include a range of multiplier differentials ranging from no difference to differing by a factor of 100.

Example 8 includes the apparatus of example 5, wherein the different limits include an unrestricted differential, the unrestricted differential corresponding to no limit on the segment-pair luminance ratio between the first and second segments.

Example 9 includes the apparatus of example 5, wherein the local dimming factor is to be represented by a single byte of data, different ones of the potential local dimming factor values corresponding to different values assigned to the single byte of data.

Example 10 includes the apparatus of example 9, wherein the different values for the single byte of data include a first range of values corresponding to a percentage differential range, a second range of values corresponding to a multiplier differential range, and a separate value corresponding to an unrestricted differential.

Example 11 includes the apparatus of example 5, wherein the backlight ratio analyzer is to determine the local dimming factor based on at least one of a type of usage of the display device, an ambient lighting condition, or user input.

Example 12 includes the apparatus of example 1, wherein the backlight analyzer is to determine a global luminance ratio between a third baseline luminance level and a full power luminance level of the backlight, the third baseline luminance level corresponding to a brightest pixel value in the pixel data corresponding to an entirety of the frame, the luminance controller to adjust the power provided to both the first segment of the backlight and the second segment of the backlight based on the global luminance ratio.

Example 13 includes the apparatus of example 1, further including a power saving analyzer to determine a value for a global dimming factor, the luminance controller to adjust the power provided to both the first segment of the backlight and the second segment of the backlight based on the global dimming factor.

Example 14 includes the apparatus of example 13, wherein the value corresponds to one of a range of possible values for the global dimming factor, different ones of the possible values to indicate respective ones of different percentages of a power saving opportunity, the power saving opportunity corresponding to a global luminance ratio between a third baseline luminance level and a full power luminance level for the backlight, the third baseline luminance level corresponding to a brightest pixel value in the pixel data corresponding to an entirety of the frame.

Example 15 includes the apparatus of example 14, wherein the different percentages of the power saving opportunity range from a 0 percent power saving to a 100 percent power saving, the luminance controller to reduce the power provided to the first and second segments of the backlight so that the operating luminance level of the first and second segments corresponds to the third baseline luminance level when the value for the global dimming factor corresponds to the 100 percent power saving, and provide full power to the first and second segments when the value for the global dimming factor corresponds to the 0 percent power saving.

Example 16 includes the apparatus of example 14, wherein the global dimming factor is to be represented by a single byte of data, different ones of the possible values corresponding to different values assigned to the single byte of data.

Example 17 includes the apparatus of example 13, wherein the power saving analyzer is to determine the value for the global dimming factor based on a type of usage of the apparatus.

Example 18 includes the apparatus of example 13, wherein the power saving analyzer is to determine the value for the global dimming factor based on an ambient lighting condition of an environment surrounding the apparatus.

Example 19 includes the apparatus of example 13, wherein the power saving analyzer is to determine the value for the global dimming factor based on a user input.

Example 20 includes a method comprising determining, by executing an instruction with at least one processor, a first baseline luminance level associated with a first segment of a backlight of a screen of a display device based on pixel data of a frame of content to be displayed via the screen, and determining, by executing an instruction with the at least one processor, a second baseline luminance level associated with a second segment of the backlight different than the first segment based on the pixel data, and determining, by executing an instruction with the at least one processor, a segment-pair luminance ratio between the first and second segments based on the first and second luminance levels, and adjusting an amount of power provided to at least one of the first segment of the backlight or the second segment of the backlight when the segment-pair luminance ratio satisfies a threshold.

Example 21 includes the method of example 20, wherein the determining of the first baseline luminance level is based on a brightest pixel value in the pixel data corresponding to a first region of the frame associated with the first segment, and the determining of the second baseline luminance level is based on a brightest pixel value in the pixel data corresponding to a second region of the frame associated with the second segment.

Example 22 includes the method of example 20, further including determining a value for a local dimming factor, the threshold defined based on the local dimming factor.

Example 23 includes the method of example 22, wherein the value corresponds to one of a range of potential local dimming factor values, different ones of the potential local dimming factor values to indicate respective ones of different limits on the segment-pair luminance ratio between the first and second segments.

Example 24 includes the method of example 23, wherein the different limits include a range of percentage differentials ranging from a 0 percent difference to a 100 percent difference.

Example 25 includes the method of example 23, wherein the different limits include a range of multiplier differentials ranging from no difference to differing by a factor of 100.

Example 26 includes the method of example 23, wherein the different limits include an unrestricted differential, the unrestricted differential corresponding to no limit on the segment-pair luminance ratio between the first and second segments.

Example 27 includes the method of example 23, wherein the local dimming factor is represented by a single byte of data, different ones of the potential local dimming factor values corresponding to different values assigned to the single byte of data.

Example 28 includes the method of example 27, wherein the different values for the single byte of data include a first range of values corresponding to a percentage differential range, a second range of values corresponding to a multiplier differential range, and a separate value corresponding to an unrestricted differential.

Example 29 includes the method of example 23, further including determining the local dimming factor based on at least one of a type of usage of the display device, an ambient lighting condition, or user input.

Example 30 includes the method of example 20, further including determining a global luminance ratio between a third baseline luminance level and a full power luminance level of the backlight, the third baseline luminance level corresponding to a brightest pixel value in the pixel data corresponding to an entirety of the frame, and adjusting the power provided to both the first segment of the backlight and the second segment of the backlight based on the global luminance ratio.

Example 31 includes the method of example 20, further including determining a value for a global dimming factor, and adjusting the power provided to both the first segment of the backlight and the second segment of the backlight based on the global dimming factor.

Example 32 includes the method of example 31, wherein the value corresponds to one of a range of possible values for the global dimming factor, different ones of the possible values to indicate respective ones of different percentages of a power saving opportunity, the power saving opportunity corresponding to a global luminance ratio between a third baseline luminance level and a full power luminance level for the backlight, the third baseline luminance level corresponding to a brightest pixel value in the pixel data corresponding to an entirety of the frame.

Example 33 includes the method of example 32, wherein the different percentages of the power saving opportunity range from a 0 percent power saving to a 100 percent power saving and further including reducing the power provided to the first and second segments of the backlight so that the operating luminance level of the first and second segments corresponds to the third baseline luminance level when the value for the global dimming factor corresponds to the 100 percent power saving, and providing full power to the first and second segments when the value for the global dimming factor corresponds to the 0 percent power saving.

Example 34 includes the method of example 32, wherein the global dimming factor is to be represented by a single byte of data, different ones of the possible values corresponding to different values assigned to the single byte of data.

Example 35 includes the method of example 31, further including determining the value for the global dimming factor based on a type of usage of the display device.

Example 36 includes the method of example 31, further including determining the value for the global dimming factor based on an ambient lighting condition of an environment surrounding an apparatus.

Example 37 includes the method of example 31, further including determining the value for the global dimming factor based on a user input.

Example 38 includes at least one non-transitory computer readable medium comprising instructions that, when executed, cause at least one processor to at least determine a first baseline luminance level associated with a first segment of a backlight of a screen of a display device based on pixel data of a frame of content to be displayed via the screen, determine a second baseline luminance level associated with a second segment of the backlight different than the first segment based on the pixel data, determine a segment-pair luminance ratio between the first and second baseline luminance levels, and adjust an amount of power provided to at least one of the first segment of the backlight or the second segment of the backlight when the segment-pair luminance ratio satisfies a threshold.

Example 39 includes the at least one non-transitory computer readable medium of example 38, wherein the instructions, when executed, cause the at least one processor to determine the first baseline luminance level based on a brightest pixel value in the pixel data corresponding to a first region of the frame associated with the first segment, and determine the second baseline luminance level based on a brightest pixel value in the pixel data corresponding to a second region of the frame associated with the second segment.

Example 40 includes the at least one non-transitory computer readable medium of example 38, wherein the instructions, when executed, cause the at least one processor to determine a value for a local dimming factor, the threshold defined based on the local dimming factor.

Example 41 includes the at least one non-transitory computer readable medium of example 40, wherein the value corresponds to one of a range of potential local dimming factor values, different ones of the potential local dimming factor values to indicate respective ones of different limits defining respective limits on the segment-pair luminance ratio between the first and second segments.

Example 42 includes the at least one non-transitory computer readable medium of example 41, wherein the different limits include a range of percentage differentials ranging from a 0 percent difference to a 100 percent difference.

Example 43 includes the at least one non-transitory computer readable medium of example 41, wherein the different limits include a range of multiplier differentials ranging from no difference to differing by a factor of 100.

Example 44 includes the at least one non-transitory computer readable medium of example 41, wherein the different limits include an unrestricted differential, the unrestricted differential corresponding to no limit on the segment-pair luminance ratio between the first and second segments.

Example 45 includes the at least one non-transitory computer readable medium of example 41, wherein the local dimming factor is represented by a single byte of data, different ones of the potential local dimming factor values corresponding to different values assigned to the single byte of data.

Example 46 includes the at least one non-transitory computer readable medium of example 45, wherein the different values for the single byte of data include a first range of values corresponding to a percentage differential range, a second range of values corresponding to a multiplier differential range, and a separate value corresponding to an unrestricted differential.

Example 47 includes the at least one non-transitory computer readable medium of example 41, wherein the instructions, when executed, cause the at least one processor to determine the local dimming factor based on at least one of a type of usage of the display device, an ambient lighting condition, or user input.

Example 48 includes the at least one non-transitory computer readable medium of example 38, wherein the instructions, when executed, cause the at least one processor to determine a global luminance ratio between a third baseline luminance level and a full power luminance level of the backlight, the third baseline luminance level corresponding to a brightest pixel value in the pixel data corresponding to an entirety of the frame, and to adjust the power provided to both the first segment of the backlight and the second segment of the backlight based on the global luminance ratio.

Example 49 includes the at least one non-transitory computer readable medium of example 38, wherein the instructions, when executed, cause the at least one processor to determine a value for a global dimming factor, to adjust the power provided to both the first segment of the backlight and the second segment of the backlight based on the global dimming factor.

Example 50 includes the at least one non-transitory computer readable medium of example 49, wherein the value corresponds to one of a range of possible values for the global dimming factor, different ones of the possible values to indicate respective ones of different percentages of a power saving opportunity, the power saving opportunity corresponding to a global luminance ratio between a third baseline luminance level and a full power luminance level for the backlight, the third baseline luminance level corresponding to a brightest pixel value in the pixel data corresponding to an entirety of the frame.

Example 51 includes the at least one non-transitory computer readable medium of example 50, wherein the different percentages of the power saving opportunity range from a 0 percent power saving to a 100 percent power saving, wherein the instructions, when executed, cause the at least one processor to reduce the power provided to the first and second segments of the backlight so that the operating luminance level of the first and second segments corresponds to the third baseline luminance level when the value for the global dimming factor corresponds to the 100 percent power saving, and provide full power to the first and second segments when the value for the global dimming factor corresponds to the 0 percent power saving.

Example 52 includes the at least one non-transitory computer readable medium of example 50, wherein the global dimming factor is represented by a single byte of data, different ones of the possible values corresponding to different values assigned to the single byte of data.

Example 53 includes the at least one non-transitory computer readable medium of example 49, wherein the instructions, when executed, cause the at least one processor to determine the value for the global dimming factor based on a type of usage of an apparatus.

Example 54 includes the at least one non-transitory computer readable medium of example 49, wherein the instructions, when executed, cause the at least one processor to determine the value for the global dimming factor based on an ambient lighting condition of an environment surrounding the display device.

Example 55 includes the at least one non-transitory computer readable medium of example 49, wherein the instructions, when executed, cause the at least one processor to determine the value for the global dimming factor based on a user input.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure.

What is claimed is:

1. An apparatus comprising:

at least one memory;

machine readable instructions; and programmable circuitry to execute the machine readable instructions to:

determine a value for a global dimming factor, the value for the global dimming factor to define a proportion of a power saving potential to be realized by dimming a backlight of a screen of a display device, the backlight including first and second segments, the first segment associated with a first luminance, the second segment associated with a second luminance, the first luminance adjustable relative to the second luminance; and adjust an amount of power provided to both the first and second segments of the backlight based on the value for the global dimming factor.

2. The apparatus of claim 1, wherein the programmable circuitry is to determine the value for the global dimming factor based on usage data indicative of a usage of the display device.

3. The apparatus of claim 2, wherein the usage data includes an indication of a type of application being used on the display device.

4. The apparatus of claim 3, wherein the programmable circuitry is to determine the value for the global dimming factor in response to a change in the type of application used on the display device, the value for the global dimming factor to remain constant during ongoing use of a single type of application on the display device.

5. The apparatus of claim 1, wherein the programmable circuitry is to determine the value for the global dimming factor based on an ambient light condition in an environment surrounding the display device.

6. The apparatus of claim 1, wherein the programmable circuitry is to determine the value for the global dimming factor based on user input.

7. The apparatus of claim 6, wherein the user input includes an indication of a preference of a user of the display device, the preference of the user corresponding to at least one of a power savings, a global backlight luminance level, or a luminance contrast.

8. The apparatus of claim 1, wherein the value for the global dimming factor is to be represented by a single byte of data.

9. The apparatus of claim 1, wherein the value for the global dimming factor defines a strength value, the strength value representative of a percentage of the power saving potential to be realized, the percentage ranging from 0 percent to 100 percent, no power saving potential to be realized when the percentage is 0 percent, a full amount of the power saving potential realized when the percentage is 100 percent.

10. At least one non-transitory computer readable medium comprising instructions to cause programmable circuitry to at least:

determine a global dimming factor value, the global dimming factor value to define a proportion of a power saving potential to be realized by dimming a backlight of a screen of a display device, the backlight including first and second segments, the first segment associated with a first luminance, the second segment associated with a second luminance, the first luminance adjustable relative to the second luminance; and adjust an amount of power provided to both the first and second segments of the backlight based the global dimming factor value.

11. The at least one non-transitory computer readable medium of claim 10, wherein the instructions are to cause the programmable circuitry to determine the global dimming factor value based on usage data indicative of a usage of the display device.

12. The at least one non-transitory computer readable medium of claim 11, wherein the usage data includes an indication of a type of application being used on the display device.

13. The at least one non-transitory computer readable medium of claim 10, wherein the instructions are to cause the programmable circuitry to determine the global dimming factor value based on an ambient light condition in an environment surrounding the display device.

14. The at least one non-transitory computer readable medium of claim 10, wherein the instructions are to cause the programmable circuitry to determine the global dimming factor value based on user input.

15. The at least one non-transitory computer readable medium of claim 14, wherein the user input includes an indication of a preference of a user of the display device, the preference of the user corresponding to at least one of a power savings, a global backlight luminance level, or a luminance contrast.

16. The at least one non-transitory computer readable medium of claim 10, wherein the global dimming factor value defines a strength value, the strength value representative of a percentage of the power saving potential to be realized, the percentage ranging from 0 percent to 100 percent, no power saving potential to be realized when the percentage is 0 percent, a full amount of the power saving potential realized when the percentage is 100 percent.

17. A method, comprising:

determining, by executing an instruction with at least one processor, a value of a global dimming factor, the value of the global dimming factor to define a proportion of a power saving potential to be realized by dimming a backlight of a screen of a display device, the backlight including first and second segments, the first segment associated with a first luminance, the second segment associated with a second luminance, the first luminance adjustable relative to the second luminance; and adjusting, by executing an instruction with the at least one processor, an amount of power provided to both the first and second segments of the backlight based on the value of the global dimming factor.

18. The method of claim 17, wherein the determining of the value of the global dimming factor is based on usage data indicative of a usage of the display device.

19. The method of claim 17, wherein the determining of the value of the global dimming factor is based on an ambient light condition in an environment surrounding the display device.

20. The method of claim 17, wherein the determining of the value of the global dimming factor is based on user input.

* * * * *